US006457603B1

(12) United States Patent
Freist et al.

(10) Patent No.: US 6,457,603 B1
(45) Date of Patent: Oct. 1, 2002

(54) CONNECTION OF TUBULAR SECTIONS OF COMBUSTIBLE PROPELLANT CHARGE CASES

(75) Inventors: Michael Freist, Furth; Klaus Redecker, Nuremberg, both of (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/530,786

(22) PCT Filed: Oct. 24, 1998

(86) PCT No.: PCT/EP98/06772

§ 371 (c)(1),
(2), (4) Date: Jun. 30, 2000

(87) PCT Pub. No.: WO99/24778

PCT Pub. Date: May 20, 1999

(30) Foreign Application Priority Data

Nov. 8, 1997 (DE) ..... 197 49 486

(51) Int. Cl.[7] ..... F16L 21/00
(52) U.S. Cl. ..... 220/678; 220/4.27; 102/282
(58) Field of Search ..... 220/678, 4.26, 220/4.27; 120/282

(56) References Cited

U.S. PATENT DOCUMENTS 3,376,816 A * 4/1968 Foster et al. ..... 220/4.27 X
5,598,928 A * 2/1997 Hossard et al. ..... 220/4.27 X
5,607,057 A * 3/1997 Eches et al. ..... 220/4.27 X
5,649,638 A * 7/1997 Roy et al. ..... 220/4.27 X

* cited by examiner

*Primary Examiner*—Steven Pollard
(74) *Attorney, Agent, or Firm*—Antonelli, Terry, Stout & Kraus, LLP

(57) ABSTRACT

The invention relates to the connection of tubular sections (1, 2) of combustible propellant charge cases consisting of one or several windings of textile threads which are connected to propellants by binding means. Said charge cases are dimensionally stable and have a high level of mechanical resistance. The aim of the invention is to create a safe, resistant, tight connection and to ensure that cracks do not form unchecked during the connection process. To this end, the tubular sections (1, 2) to be connected are inserted into each other, said inserted tubular sections (1, 2) are connected by means of a non-releasable snap connection, and at least one longitudinal cut (3) is made in an axial direction, extending in the area of the connection.

5 Claims, 2 Drawing Sheets

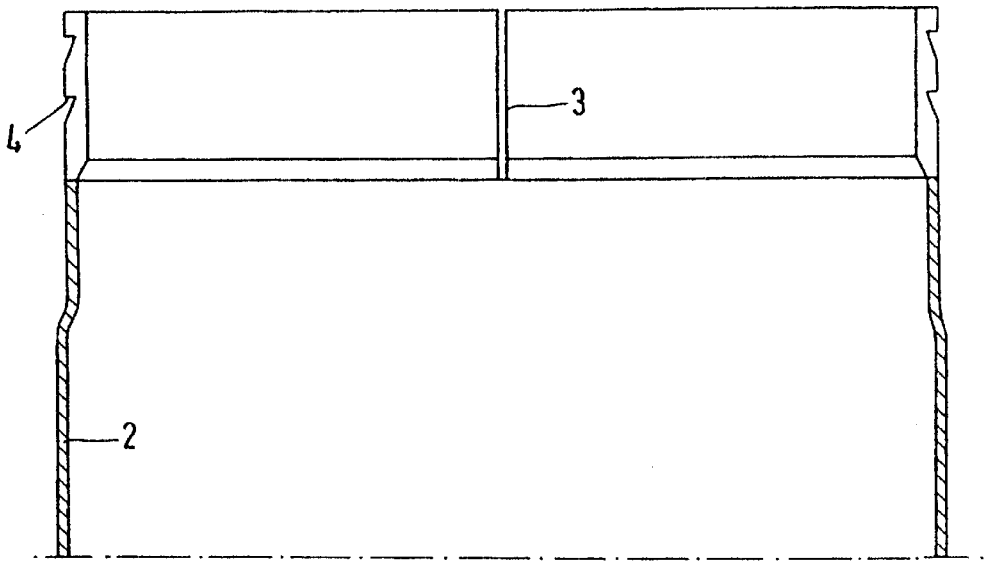
FIG.4
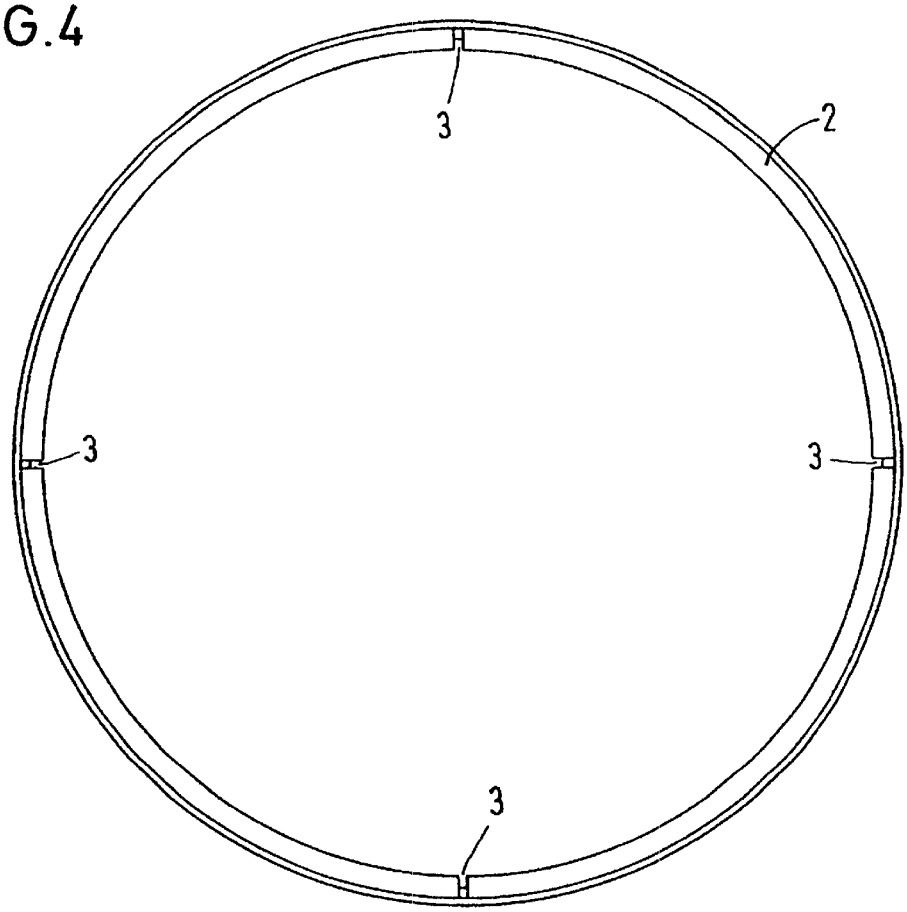

CONNECTION OF TUBULAR SECTIONS OF COMBUSTIBLE PROPELLANT CHARGE CASES

BACKGROUND OF THE INVENTION

The invention relates to the connection of tube sections of combustible propellant charge cases in accordance with the preamble of claim 1.

A combustible propellant charge case is known from DE 30 34 360 A1 which consists of at least two flexible tube parts with connection sections which can be inserted into each other coaxially and which have radially deformable elements engaging into each other.

However, the invention relates to the connection of tube sections of combustible propellant charge cases consisting of one or several windings of textile threads which are connected by binders, with the binders containing propellants. In contrast with those of DE 30 34 360 A1, these propellant charge cases are dimensionally stable and have a high level of mechanical strength. Therefore, for example, the tearing strength with the same wall thickness of the case, is greater by a factor of 40–56 in comparison with the case according to DE 30 34 360 A1. Such a propellant charge case is described in the generic DE 38 25 581 C1.

The object underlying the invention is to provide a connection of tube sections of combustible propellant charge cases comprising one or several windings of textile threads which are connected to propellant by means of binders, and with the propellant charge cases being dimensionally stable and having a high level of mechanical strength, with which, also with these dimensionally stable propellant charge cases, there is achieved a safe, strong and tight connection and with which no uncontrolled cracking can arise during the connection process. This connection technique is required, for example, for the assembly of ammunition, for securing the projectile or even for the securing of the combustible part to the metallic base plate which accommodates the ignition and undertakes the sealing of the hot combustion gases, when the propellant charge powder burns away, from the cartridge chamber.

In accordance with the invention, the object is achieved by having the tube sections to be connected inserted into each other, by having the tube sections which are inserted into each other connected by way of a non-releasable snap connection, and by having arranged in the axial direction at least one lengthwise cut extending in the region of the connection.

The insertion of the tube sections which are to be connected, one into another, in conjunction with the snap connection, effects a safe, strong and tight connection. To facilitate the insertion of the tube sections into each other and to avoid uncontrolled cracking in the tube sections, there is at least one longitudinal cut in the axial direction, extending in the region of the connection. This is an essential feature of the invention, which only provides the desired results in combination with the other features mentioned.

In an advantageous embodiment the tube sections are latched by way of barbs. The barbs can have a contour which is, for example, rectangular in cross section, or, on the other hand, they can also preferably have a contour which is rounded in cross section. This facilitates the insertion of the two tube sections into each other.

In a preferred embodiment, in addition to the snap connection mentioned, adhesive is also used. For this purpose, annular depressions or grooves to receive adhesives are advantageously arranged on the connection surface of the tube sections. The adhesive can then be distributed from these depressions and grooves into the available positions during insertion into each other. Hardenable multi-component systems, for example based on a polyurethane or epoxy resin, are preferably used as adhesive.

In an alternative embodiment, circumferential sealing rings on the connection surface are arranged radially in place of the barbs, which sealing rings are embedded in the two tube sections to be connected. Otherwise the connection surfaces are designed to be flat.

In addition to the preferred form of the design of the connections by way of "snappable" systems, further embodiments can be used. These are, for example, thread, bayonet and conical shapes. In all cases the simultaneous use of adhesives is preferred.

The connection is preferably used with ammunition components and ammunition cases.

Further features of the invention are evident from the figures which are described in the following:

FIG. 4 shows a tube section and in a top view with longitudinal cuts in the region of the connection.

Figure 1:
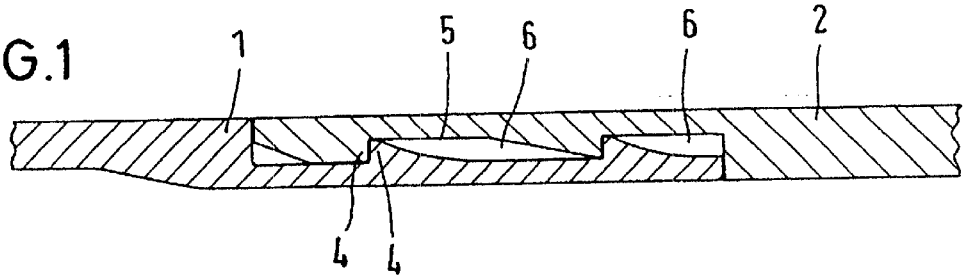
FIG. 1 shows, in section, two tube sections, which are connected to each other by way of barbs.

FIG. 1 shows in section, a detail of two tube sections 1, 2 of a combustible propellant charge case consisting of one or more windings of textile threads which are connected to propellant by means of binders. These tube sections 1, 2 are dimensionally stable and have a high level of mechanical strength. For the connection, the tube sections 1, 2 are inserted into each other, with the outer surfaces of the two tube sections 1, 2 passing over into each other without attachment. For this purpose, the tube section 1 has at its connection area an outer narrowing in which the connection area of the tube section 2 is laid. In this respect, the two tube sections 1, 2, inserted into each other, are connected by way of a non-releasable snap-connection. The snap connection consists of barbs 4 at the respective tube sections 1, 2 which engage into each other and in this way produce a latching. On the connection surface 5 of the two tube sections 1, 2 are arranged annular, that is to say circumferential, depressions or grooves 6 for receiving adhesive.

Figure 2:
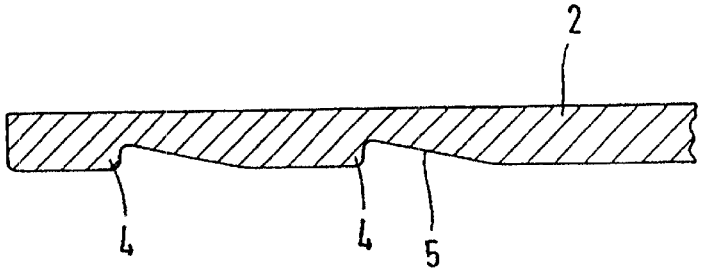
FIG. 2 shows a tube section with rounded barbs.

FIG. 2 shows a detail of an alternative tube section 2 with rounded barbs 4. This tube section 2 could be combined, that is to say connected, with the tube section 1 according to FIG. 1. Insertion into each other is facilitated by way of the rounded barbs 4.

Figure 3:
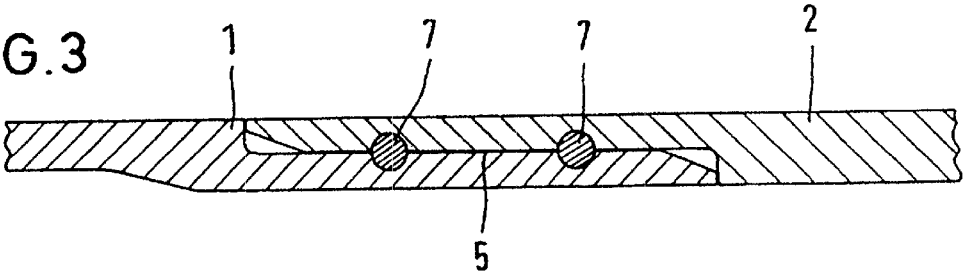
FIG. 3 shows two tube sections which are connected to each other by way of a sealing ring.

FIG. 3 shows an alternative embodiment with tube sections 1, 2 which are inserted into each other and have a flat connection surface 5. For the latching, two radially circumferential sealing rings 7 which are embedded in the two tube sections 1, 2, half and half, are arranged on the connection surface 5. According to the purpose of use, several sealing rings 7 can even be used.

FIG. 4 shows in section and top view a tube section similar to FIG. 1. Essential for the invention are longitudinal cuts 3 which extend in the axial direction in the region of the connection. An embodiment is shown with four longitudinal cuts 3, which are each arranged at an angle of 90° to each other. These longitudinal cuts 3 render possible the insertion of the tube sections 1, 2 into each other, without the formation of cracks.

By propellants are understood to be meant in particular high-energy substances according to DE 38 25 581 C1.

What is claimed is:

1. Connection of tube sections of combustible propellant charge cases comprising one or several windings of textile threads which are connected to propellant by means of binders, and with the propellant charge cases being dimensionally stable and having a high level of mechanical strength, comprising:

providing tube sections to be connected to each other, a first tube section of the tube sections having a first end shaped to be insertable into an end of a second tube section, inserting the first end of the first tube section into the end of the second tube section, and connecting the first and second tube sections by way of a non-releasable snap connection with radially circumferential sealing rings, which are embedded in the first and second tube sections and arranged on the connection surface, wherein there is arranged in the axial direction at least one longitudinal cut in at least one of the first and second tube sections extending in the region of the connection.

2. Connection according to claim 1, characterized in that the at least one longitudinal cut is provided on the first end of the first tube section.

3. A propellant charge case, comprising:

a first tube section comprising one or more windings of textile threads connected to propellant by a binder;

a second tube section comprising one or more windings of textile threads connected to propellant by a binder;

an end of the first tube section having a narrowed end inserted within an end of the second tube section;

a non-releasable snap connection comprising radially circumferential sealing rings, which are embedded in the first and second tube sections and arranged on the connection surface connecting the ends of the first and second tube sections; and at least one longitudinal cut provided in the end of at least one of the first and second tube sections, the longitudinal cut extending in the axial direction in the region of the snap connection.

4. The propellant charge case according to claim 3, wherein the at least one longitudinal cut is provided in the narrowed end of the first tube section.

5. The propellant charge case according to claim 3, wherein a plurality of axially extending longitudinal cuts are provided at spaced intervals around the circumference of the narrowed end of the first tube section.

* * * * *